US006596157B2

(12) United States Patent
Gupta et al.

(10) Patent No.: US 6,596,157 B2
(45) Date of Patent: Jul. 22, 2003

(54) STAGED HYDROTREATING METHOD FOR NAPHTHA DESULFURIZATION

(75) Inventors: Brij Gupta, Oakton, VA (US); John P. Greeley, Annandale, NJ (US); Thomas R. Halbert, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/815,686

(22) Filed: Mar. 23, 2001

(65) Prior Publication Data

US 2002/0005373 A1 Jan. 17, 2002

Related U.S. Application Data

(60) Provisional application No. 60/194,443, filed on Apr. 4, 2000.

(51) Int. Cl.[7] ..... C10G 65/14; C10G 65/16

(52) U.S. Cl. ..... 208/210; 208/211; 208/217; 208/218; 208/80; 208/216 R; 208/216 PP

(58) Field of Search ..... 208/210, 211, 208/216 R, 216 PP, 217, 80, 219

(56) References Cited

U.S. PATENT DOCUMENTS 2,913,405 A * 11/1959 Shalit ..... 208/211
2,983,669 A * 5/1961 Noll ..... 208/209
3,157,589 A 11/1964 Scott, Jr. et al. ..... 208/80
3,224,958 A 12/1965 Schlinger ..... 208/78
3,265,610 A 8/1966 Lavergne et al. ..... 208/80
3,540,996 A 11/1970 Maziuk et al. ..... 208/65
3,788,976 A * 1/1974 Kirk ..... 208/143
3,830,731 A 8/1974 Reed, Jr. et al. ..... 208/211
3,843,508 A 10/1974 Wilson, et al. ..... 208/89
4,131,537 A 12/1978 Winter et al. ..... 208/216
4,234,410 A 11/1980 Kelley ..... 208/57
4,243,519 A 1/1981 Schorfheide ..... 208/210
4,397,739 A * 8/1983 Jacquin et al. ..... 208/210
4,990,242 A 2/1991 Louie et al. ..... 208/218
5,985,136 A 11/1999 Brignac et al. ..... 208/216
6,103,105 A 8/2000 Cooper et al. ..... 208/210
6,126,814 A * 10/2000 Lapinski et al. ..... 208/216 R
6,197,718 B1 3/2001 Brignac et al. ..... 502/216
6,334,948 B1 * 1/2002 Didillon et al. ..... 208/216 R

* cited by examiner

*Primary Examiner*—Walter D. Griffin
(74) *Attorney, Agent, or Firm*—Gerard J. Hughes

(57) ABSTRACT

The invention relates to a method and dual reactor system for hydrotreating a wide cut cat naphtha stream comprising heavy cat naphtha (HCN) and intermediate cat naphtha (ICN). Accordingly, a HCN fraction is hydrotreated under non-selective hydrotreating conditions and an ICN fraction is hydrotreated under selective hydrotreating conditions. The hydrotreated HCN and ICN effluents may be conducted to heat exchangers to pre-heat the ICN feed, obviating the need for a furnace.

6 Claims, 1 Drawing Sheet

STAGED HYDROTREATING METHOD FOR NAPHTHA DESULFURIZATION

CROSS-REFERENCE TO RELATED APPLICATIONS

This patent application claims benefit of U.S. provisional patent application Ser. No. 60/194,443 filed Apr. 4, 2000.

FIELD OF THE INVENTION

The invention relates to a method and dual reactor system for hydrotreating a wide cut cat naphtha stream comprising heavy cat naphtha (HCN) and intermediate cat naphtha (ICN). Accordingly, a HCN fraction is hydrotreated under non-selective hydrotreating conditions and an ICN fraction is hydrotreated under selective hydrotreating conditions. The hydrotreated HCN and ICN effluents may be conducted to heat exchangers to pre-heat the ICN feed, obviating the need for a furnace.

BACKGROUND OF THE INVENTION

The need for low-emissions, high-octane fuels has led to a need for fuels processes that diminish the concentration of sulfur-containing species in the fuel without substantially changing the fuel's octane number.

Conventional fuel processes for sulfur removal include contacting a naphtha with a catalyst in the presence of hydrogen under catalytic conversion conditions. One such technique, called catalytic hydrodesulfurization (HDS), involves reacting hydrogen with the sulfur compounds in the presence of a catalyst. HDS is one process within a class of processes called hydrotreating, or hydroprocessing, involving the introduction and reaction of hydrogen with various hydrocarbonaceous compounds. Hydrotreatment has been used to remove sulfur, nitrogen, and other materials such as metals.

Cracked naphtha obtained as a product of, for example, fluid catalytic cracking, steam cracking, thermal cracking, or coking may contain a significant concentration of sulfur up to as much as 13,000 ppm. Although the cracked naphtha streams constitute approximately half of the total gasoline pool, cracked naphtha contributes a substantially higher percentage of undesired sulfur to the gasoline pool. The remainder of the pool typically contains much lower quantities of sulfur.

Hydroprocessing cracked naphtha typically results in a product having a diminished concentration of olefinic species and non-hydrocarbyl species such as sulfur-containing species, and an augmented concentration of saturated species. Relatively severe hydroprocessing conditions are generally required to substantially remove sulfur-containing species, and such severe hydroprocessing conditions are known to result in a substantial octane number reduction in the hydroprocessed product.

Some conventional sulfur removal processes attempt to overcome the octane number reduction problem by making use of the non-uniform distribution of olefins and sulfur-containing species across the naphtha boiling range. In a typical naphtha, olefins are most concentrated and the sulfur concentration is relatively low in the fraction boiling between about 90° F. and 150° F., i.e., the light cat naphtha or "LCN" fraction. Sulfur species are most concentrated and the olefin concentration is relatively low in the heavy cat naphtha or "HCN" boiling range, typically about 350° F. to about 430° F. Intermediate cat naphtha ("ICN") typically boils in the range of about 150° F. to about 350° F. and may contain significant amounts of both sulfur species and olefins. Sulfur species in the LCN fraction may be removed by caustic extraction without undesirable olefin saturation, while the ICN and HCN fractions generally require hydrotreating to remove the sulfur.

In one conventional process, the ICN fraction is hydrotreated under relatively mild conditions in order to lessen the amount of olefin saturation, while the HCN fraction is hydrotreated under more severe conditions. One disadvantage of this approach relates to the complexity and costs associated with operating two independent hydrotreating units and their associated feed pre-heating equipment.

There remains a need, therefore, for new processes for forming naphtha having a diminished concentration of sulfur-containing species, while maintaining a sufficient olefin concentration to provide a relatively high octane number.

SUMMARY OF THE INVENTION

In an embodiment, the invention relates to a method for hydrotreating heavy cat naphtha and intermediate cat naphtha streams. The method comprises hydrotreating a heavy cat naphtha feedstream having a HCN initial sulfur content and a HCN initial olefin content under HCN hydrotreating conditions effective to produce an HCN effluent at an elevated temperature having a HCN effluent sulfur content and a HCN effluent olefin content. An intermediate cat naphtha stream at an initial temperature is heated with the HCN effluent, via a heat exchanger for example, and thereby heated from the initial temperature to an increased temperature. The increased temperature ICN stream is hydrotreated under ICN hydrotreating conditions which are less severe than the HCN hydrotreating conditions to produce an ICN effluent having an ICN effluent sulfur content and an ICN effluent olefin content. In a preferred embodiment, the HCN effluent and the ICN effluent are combined, and the combined stream may be subjected to product separation procedures or conducted away from the process for storage or further processing. It is also preferred that HCN hydrotreating conditions be controlled to provide an HCN effluent having a temperature at least about 25° F. higher than the ICN hydrotreater's inlet temperature. More preferably, HCN and ICN hydrotreating conditions are controlled so that the HCN and ICN are both in the vapor phase (i.e., always above the dew point) during the hydrotreating operation.

DETAILED DESCRIPTION OF THE INVENTION

Figure 1A:
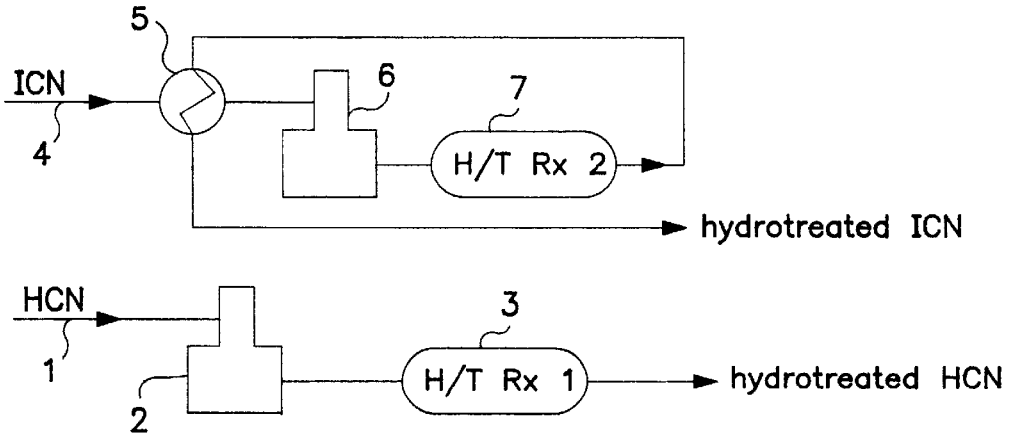
Prior Art FIG. 1A
FIG. 1A is a dual reaction system used in conventional sulfur removal processes.

The invention is based on the discovery that ICN and HCN hydrotreating may be integrated in a staged reactor system to provide a low sulfur naphtha without substantially reducing the naphtha's octane number. More specifically, it has been discovered that regulating the HCN hydrotreating reactor conditions to saturate more than about 50 wt. % of the olefins in the HCN results in a HCN effluent temperature in the range of about 525° F. to about 700° F. Further such conditions would result in an effectively desulfurized HCN having a higher effluent temperature than would be achieved at lower levels of olefin saturation. Consequently, when operating under such HCN hydrotreating conditions, heat from the HCN effluent is useful for preheating ICN conducted to the ICN hydrotreater for selective sulfur removal without olefin saturation. Although the ICN and HCN effluent could be treated using two separate trains of separation equipment, the two effluents preferably are combined and treated together using common separation equipment and techniques.

Preferred naphtha boiling range feed streams are typically those having a boiling range from about 65° F. to about 430° F., preferably from about 150° F. to about 430° F. The naphtha can be any stream predominantly boiling in the naphtha boiling range and containing olefin, such as a thermally cracked or a catalytically cracked naphtha. Such streams can be derived from any appropriate source, for example, they can be derived from the fluid catalytic cracking ("FCC") of gas oils and resids in a FCC unit ("FCCU"), or they can be derived from delayed or fluid coking of resids, or from steam cracking and related processes. It is preferred that the naphtha feed streams be derived from the fluid catalytic cracking of gas oils and resids. Such naphthas are typically rich in olefins and in some cases diolefins and relatively lean in paraffins.

The naphtha, preferably a cracked naphtha from a FCCU, generally contains not only paraffins, naphthenes, and aromatics, but also unsaturates, such as open-chain and cyclic olefins, dienes, and cyclic hydrocarbons with olefinic side chains. The cracked naphtha generally comprises an overall olefins concentration ranging as high as about 60 wt. %, more typically as high as about 50 wt. % and most typically from about 5 wt. % to about 40 wt. %. The cracked naphtha sulfur content will generally range from about 0.05 wt. % to about 0.7 wt. %, and more typically from about 0.07 wt. % to about 0.5 wt. % based on the total weight of the feedstock. Nitrogen content will generally range from about 5 wppm to about 500 wppm, and more typically from about 20 wppm to about 200 wppm.

Preferably, an ICN and a HCN fraction are separated from the naphtha feed stream, for example, by fractionation. Typically, FCCU main fractionators either are designed or can be modified to produce an about 350° F. to about 430° F. HCN side stream and an initial to about 350° F. raw gasoline cut which is debutanized to produce $C_5$ to about 350° F. FCC light gasoline. The $C_5$ to about 350° F. FCC light gasoline stream can be fractionated to produce a $C_5$ to about 150° F. LCN cut and an about 150° F. to about 350° F. ICN cut. The LCN cut may be desulphurized via conventional caustic extraction. Alternately, topping of the debutanized $C_5$ to about 350° F. gasoline may employ other conventional desulfurizing technology to produce a desulphurized LCN product and a sulfur bearing ICN cut as the feed for the ICN reactor. Preferably the feed to the HCN reactor is the about 350° F. to about 430° F. (or about 325° F. to about 430° F.) cut from the fractionator. The cut point between the LCN and ICN streams can be as low as about 11° F. and as high as about 200° F. The cut point between the ICN and HCN streams can be as low as about 300° F. and high as about 400° F.

Figure 1B:
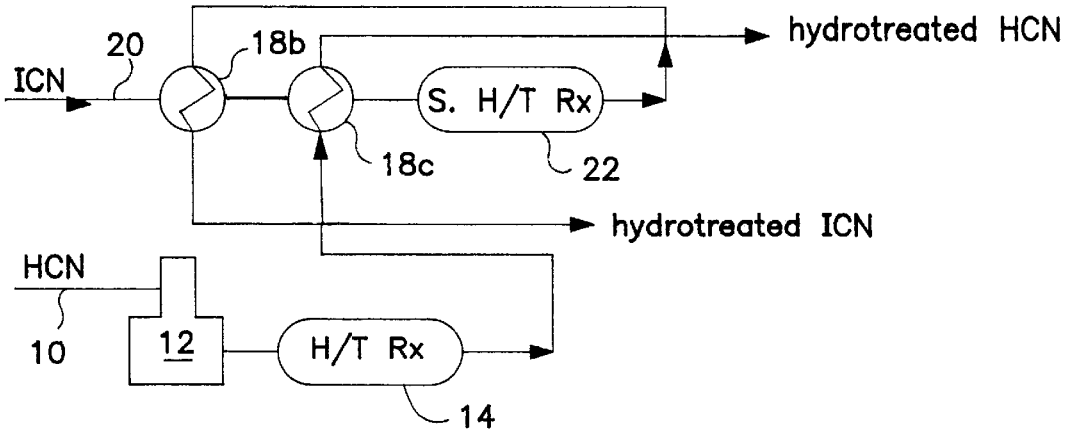
FIG. 1B is a staged hydrotreater system suitable for use in the present invention.

The system of the present invention will be better understood with reference to FIG. 1B. Referring to FIG. 1B, a HCN fraction at a temperature below about 430° F. (10) preferably is conducted from a FCCU separation zone, such as a fractionater (not shown), to a heater (12), preferably a fired heater, where the HCN fraction is mixed with hydrogen gas and heated to the desired reaction temperature. The heated HCN fraction then is conducted to the HCN reactor (14) where the conditions are sufficiently severe to result in more than about 95% HCN desulfurization and more than about 50 wt. % olefin saturation.

HCN hydrotreating may be conducted under conditions that result in significant olefin saturation during desulfurization, i.e., non-selective hydrotreating conditions. HCN hydrotreater inlet temperature ranges from about 500° F. to about 650° F. HCN hydrotreater operating pressures are maintained at from about 80 psig to about 2000 psig, preferably at from about 200 psig to about 500 psig. Hydrogen treat rates range from about 200 standard cubic feet/barrel (SCF/B) to about 4000 SCF/B, preferably from about 500 to about 2000 SCF/B. The feed rate may vary from about 0.2 LHSV to about 20 LHSV (liquid hourly space velocity), preferably from about 1 LHSV to about 5 LHSV. Such conditions, result in a HCN effluent having (i) more than about 95 wt. % desulfurization and more than about 50 wt. % olefin saturation, the amount of desulfurization and olefin saturation being based, respectively, on the weight of the sulfur and the weight of olefins in the heated HCN fraction;

(ii) an HCN effluent temperature ranging from about 525° F. to about 700° F.; and (iii) a sufficient quantity of HCN effluent that upon heating the ICN hydrotreater feed with the HCN and ICN effluents, the ICN hydrotreater inlet temperature is attained, obviating the need for an ICN preheat furnace.

HCN hydrotreating may be conducted in one or more hydrotreating reactors in the presence of hydrogen and a catalytically effective amount of a hydrotreating catalyst. As discussed, the HCN may contact or be mixed with hydrogen before heating in heater (12). Additional hydrogen may also be added directly to the HCN reactor. Hydrogen may be obtained from a hydrogen-containing stream that can be pure hydrogen or can be in a mixture with other components found in refinery hydrogen streams. It is preferred that the hydrogen-containing stream have little, if any, hydrogen sulfide. The hydrogen stream purity should be a least about 50% by volume hydrogen, preferably at least about 65% by volume hydrogen, and more preferably at least about 75% by volume hydrogen for best results.

The HCN hydrotreating reaction zone can consist of one or more fixed bed reactors, each of which can comprise a plurality of catalyst beds. Some olefin saturation will take place, and olefin saturation and the desulfurization reaction are generally exothermic, consequently interstage cooling between fixed bed reactors, or between catalyst beds in the same reactor shell, can be employed. However, generally it is preferred to retain all of the heat generated from these reactions for use in heating the ICN feed stream.

Preferred catalysts for HCN hydrotreating include conventional hydrodesulfurization catalysts. Generally, these catalysts comprise a hydrogenation component such as a metal, metal oxide or metal sulfide of a Group VIB and a Group VIII non-noble metal of the Periodic Table of Elements on a suitable support, such as, for example cobalt-molybdenum or nickel-molybdenum on a predominantly alumina support which may further comprise minor amounts of silica or other refractory oxides. The Periodic Table referred to herein is given in Handbook of Chemistry and Physics, published by the Chemical Rubber Publishing Company, Cleveland, Ohio, 45th Edition, 1964. The oxide catalysts are preferably sulfided prior to use.

The second hydrotreater stage, relating to ICN hydrotreating, will also be described with reference to FIG. 1B. As shown in the figure, an ICN fraction (20) at a temperature below 400° F. is conducted from the FCCU fractionator (not shown) to a heat exchanger (18*b*) where the ICN is heated by effluent from the ICN hydrotreater (22). As discussed, ICN hydrotreater effluent is used to heat, via a heat exchanger for example, the ICN feed to form a heated ICN. A sufficient amount of HCN effluent at a temperature higher than that of the heated ICN is conducted to a second heat exchanger (18*c*) to heat the heated ICN feed to an ICN inlet temperature ranging from about 475° F. to about 550° F., obviating the need for an external heat source such as an ICN pre-heat furnace.

Preferably, the HCN hydrotreater is operated so that the temperature of the HCN effluent exceeds the ICN hydrotreater inlet temperature by at least about 25° F. Consequently, the amount of heat transferred from the HCN effluent to the ICN may be controlled to provide the appropriate ICN hydrotreater inlet temperature. It should be clear to those skilled in the art that the HCN effluent's effectiveness for preheating the ICN feed is related to the relative temperatures and relative amounts of HCN effluent and ICN feed. Consequently, it is within the scope of this invention to adjust the cut points between the ICN and HCN as well as between the LCN and ICN to regulate the relative amounts, temperatures, and combinations thereof of the HCN and ICN feeds to provide sufficient heat to the ICN feed to reach the desired ICN hydrotreater inlet temperature ICN hydrotreating is conducted under selective hydrotreating conditions in order to lessen the amount of olefin saturation during desulfurization. This has the benefit of minimizing the loss of octane number. However, it also reduces the amount of heat generated from olefin saturation lowering the amount of heat available in heat exchanger 18*b*. An additional heat from the HCN effluent is added through exchanger 18*c*. Selective hydrotreating conditions are generally less severe than the HCN hydrotreating conditions in the first stage of the invention. The use of a selective HDS catalyst is the preferred means by which olefin saturation in the ICN reactor is minimized. Preferably, fewer than 50 wt. % of the olefins, based on the weight of the ICN feed, are saturated in the ICN reactor. More preferably, the inlet temperature of the ICN reactor ranges from about 47° F. to about 600° F., and is at least 25° F. lower than the inlet temperature of the HCN reactor.

The ICN hydrotreater is preferably operated in the vapor phase at an inlet temperature ranging from about 475° F. to about 600° F., and with an effluent temperature ranging from about 525° F. to about 675° F. Reactor pressures preferably range from about 100 psig to about 300 psig, hydrogen treat rates range from about 1000 SCF/B to about 2500 SCF/B, and ICN feed rates range from about 1 LHSV to about 5 LHSV. Such conditions result in an ICN effluent having a temperature ranging from about 525° F. to about 675° F.

As in the HCN stage, the ICN hydrotreating may be conducted in one or more hydrotreating reactors in the presence of hydrogen and a catalytically effective amount of a hydrotreating catalyst. The hydrogen may be obtained from sources described in the description of the HCN stage. And as in the HCN stage, the hydrotreater reactor zone may consist of one or more fixed bed reactors, each of which may comprise a plurality of catalyst beds, and interstage cooling between reactors or beds may be employed.

Preferred hydrotreating catalysts for use in the ICN stage have a relatively high level of activity for hydrodesulfurization in combination with a relatively low tendency to saturate olefins. For example, some conventional hydrosulfurization catalysts typically contain $MoO_3$ and CoO levels within the ranges of those in the catalyst described herein. Other hydrodesulfurization catalysts have surface areas and pore diameters similar to those of the preferred catalysts.

One preferred catalyst has the following properties: (a) a $MoO_3$ concentration of about 1 to 10 wt. %, preferably about 2 to 8 wt. %, and more preferably about 4 to 6 wt. %, based on the total weight of the catalyst; (b) CoO concentration of about 0.1 to 5 wt. %, preferably about 0.5 to 4 wt. %, and more preferably about 1 to 3 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ g $MoO_3/m^2$, preferably about $0.75\times10^{-4}$ to about $2.5\times10^{-4}$, more preferably from about $1\times10^{-4}$ to about $2\times10^{-4}$; and (f) an average particle size diameter of less than 2.0 mm, preferably less than about 1.6 mm, more preferably less than about 1.4 mm, and most preferably as small as practical for commercial hydrodesulfarization process unit. Most preferred catalysts also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity," S. J. Tauster et al., *Journal of Catalysis* 63, pp. 515–519(1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to 2,800 preferably from about 1,000 to 2,200, and more preferably from about 1,200 to 2,000 $\mu$mol oxygen/gram $MoO_3$. The terms hydrotreating and hydrodesulfurization are sometimes used interchangeably in this document.

The catalyst preferably is supported catalyst. Any suitable inorganic oxide support material may be used. Non-limiting examples of suitable support materials include: alumina, silica, titania, calcium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate. Preferred supports are alumina, silica and silica-alumina. A most preferred support is alumina. For the catalyst with a high degree of metal sulfide edge plane area, magnesia can also be used.

The support material may contain a small amount of contaminants, such as Fe sulfates, silica and various metal oxides, which can be present during the preparation of the support material. These contaminants are present in the raw materials used to prepare the support and preferably will be present in amounts less than about 1 wt. %, based on total weight of the support. It is more preferred that the support material be substantially free of such contaminants.

In one embodiment, the support comprises about 0 to 5 wt. %, preferably from about 0.5 to 4 wt. %, and more preferably from about 1 to 3 wt. %, of one or more additives selected from phosphorous and metals or metal oxides from Group IA (alkali metals) of the Periodic Table of the Elements.

The metals of the catalyst of the present invention can be deposited or incorporated upon the support by any suitable conventional means, such as by impregnation employing heat-decomposable salts of Group VIB and VIII metals or other methods know to those skilled in the art such as ion-exchange, with impregnation methods being preferred. Suitable aqueous impregnation solutions include, but are not limited to cobalt nitrate, ammonium molybdate, nickel nitrate, and ammonium metatungstate.

Impregnation of the hydrogenation metals on the catalyst support using the above aqueous impregnation solutions can be performed using incipient wetness techniques. The catalyst support is precalcinized and the amount of water to be added to just wet all of the support is determined. The aqueous impregnation solutions are added such that the aqueous solution contains the total amount of hydrogenation component metal(s) to be deposited on the given mass support. Impregnation can be performed for each metal separately, including an intervening drying step between impregnations, or as a simple co-impregnation step. The saturated support can then be separated, drained, and dried in preparations for calcination. Calcination generally is preformed at a temperature of from about 480° F. to about 1,200° F., or more preferably from about 800° F. to about 1,100° F.

The invention is an improvement over conventional processes for separately hydrotreating heavy and intermediate catalytically cracked naphtha fractions. In a conventional process, illustrated in FIG. 1A, HCN (1) from a naphtha fractionator (not shown) is conducted to a furnace (2) where it is heated to the appropriate reactor inlet temperature. The heated HCN is then conducted to hydrotreater (3), and the hydrotreated naphtha is conducted away from the process. Similarly, an ICN fraction (4) is conducted from a naphtha fractionator (not shown) to heat exchanger (5) where hydrotreated ICN effluent from ICN hydrotreater (7) preheats the ICN. The pre-heated ICN is then conducted to a furnace (6) where heat is added to the ICN until it attains a temperature appropriate for the inlet of ICN hydrotreater (7). Although the ICN hydrotreater may be operated under selective hydrotreating conditions that generally lead to reduced olefin saturation, the high olefin content of the ICN results in sufficient heat generation in ICN reactor (7) to warrant use of the ICN reactor effluent to provide part of the heat required by the ICN feed in exchanger (7). However, a furnace (6), or some other heat generating equipment, would be required to sufficiently heat the ICN further so that it reaches the reactor (7) inlet temperature.

This difficulty is overcome in the process illustrated in FIG. 1B because hot HCN effluent from HCN hydrotreater (14) provides heat to the ICN fraction in heat exchanger (18*c*). Conditions in HCN reactor (14) are regulated so that the hydrotreated HCN effluent is sufficient in quantity and temperature to preheat the ICN feed to the ICN hydrotreater (22). ICN hydrotreater (22) is operated under selective hydroprocessing conditions, but with sufficient severity that the heat from its effluent in heat exchanger (18*b*) together with the heat from the HCN effluent in heat exchange (18*c*) are in total sufficient to overcome the need for furnace (6) that would be required in the conventional process.

EXAMPLES

1. This example, based on model calculations and illustrated in FIG. 1A, shows that while the conventional process is capable of providing desulfurized HCN and a hydrotreated ICN without undesirable ICN olefin saturation, the process requires the use of a furnace to preheat the ICN. Accordingly, 9,000 Barrels/day (9 Kbd) of an ICN fraction at a temperature of 320° F. and a pressure of about 50 psia is conducted from separation equipment to a pump (not shown), and the pump's ICN effluent is combined with about 1500 scf/bbl of a hydrogen-containing treat gas having a temperature of about 180° F. and a pressure of about 350 psia. The combined ICN-treat gas (4) at a temperature of about 300° F. enters ICN heat exchanger (5), and the heat exchanger's effluent has a temperature of 450° F., i.e., outside the range of preferred ICN hydrotreater (7) inlet temperature. A furnace (6) is therefore required to increase the ICN hydrotreater inlet temperature into the preferred range, in this example 500° F. For a model ICN feed having 1500 ppm sulfur and a bromine number of 50, selective hydrotreating conditions in (7) would result in a product having 30 ppm sulfur (98% HDS), a bromine number of 30.8(about 38% olefin saturation), and product temperature about 120° F. higher than the hydrotreater inlet temperature. As shown in the figure, the product is conducted to the heat exchanger (5) to provide the heat required for increasing the combined ICN-treat gas from 300° F. to 450° F.

Conventional processing of the HCN fraction is also illustrated in FIG. 1A. 3 Kbd of an HCN fraction at a temperature of about 400° F. and a pressure of about 50 psia is conducted from separation equipment to a pump (not shown), and the pump's HCN effluent is combined with about 1500 scf/bbl of a hydrogen-containing treat gas having a temperature of about 180° F. and a pressure of about 350 psia. The combined HCN-treat gas (1) at a temperature 380° F. enters furnace (2) and is heated into the desired HCN hydrotreater (3) inlet temperature range, 620° F. in this example. For a model HCN feed having 4000 ppm sulfur and a bromine number of 13, non-selective hydrotreating conditions in (3) would result in a product having 5 ppm sulfur, a bromine number of 3 and product temperature about 60° F. higher than the HCN hydrotreater inlet temperature. The HCN effluent would therefore have a temperature of about 680° F. While not illustrated in the figure, HCN effluent may be used to pre-heat the combined HCN-treat gas, for example via at heat exchange, in order to reduce the heating requirements of furnace (2).

2. This example, based on model calculations and illustrated in FIG. 1B, shows the benefits of the invention. As in example 1, 9 Kbd of the same model ICN fraction at a temperature of 320° F. and a pressure of about 50 psia is conducted from separation equipment to a pump (not shown), and the pump's ICN effluent is combined with about 1500 scf/bbl of a hydrogen-containing treat gas having a temperature of about 180° F. and a pressure of about 350 psia. ICN reactor (22) conditions are as set forth in example 1. The combined ICN-treat gas (20) at a temperature of about 300° F. enters a first heat exchanger (18*b*), where the 620° F. effluent of ICN hydrotreater (22) is used to heat the combined ICN-treat gas to a temperature of 450° F. The ICN-treat gas effluent from the first heat exchanger is conducted to a second heat exchanger (18*c*) where the ICN-treat gas is further heated by the HCN hydrotreater's (14) product. For the same amount and type of HCN model feed as in example 1, and under the conditions set forth therein, the HCN hydrotreater would have an effluent with a temperature of about 680° F. The second heat exchanger's ICN-treat gas effluent would therefore be about 500° F., i.e., in the preferred ICN hydrotreater inlet temperature range, and no furnace or other external heat source need be employed to achieve the preferred ICN hydrotreater inlet temperature.

What is claimed is:

1. A staged hydrotreating method comprising:

(a) contacting a heavy cat naphtha containing sulfur and olefins with a catalytically effective amount of a first hydrotreating catalyst in the presence of hydrogen under non-selective conversion conditions to:

(i) remove at least about 95 wt. % sulfur, based on the weight of the sulfur in the heavy cat naphtha and (ii) saturate at least about 50 wt. % olefin, based on the weight of the olefins in the heavy cat naphtha in order to form a hydrotreated heavy cat naphtha at a first temperature;

(b) contacting a heated intermediate cat naphtha containing sulfur and olefins at a second temperature with a catalytically effective amount of second hydrotreating catalyst in the presence of hydrogen under selective hydrotreating conditions to (i) remove at least about 95 wt. % of the sulfur, based on the weight of the sulfur in the heated intermediate cat naphtha and (ii) saturate less than about 50 wt. % of the olefins, based on the weight of the olefins present in the heated intermediate cat naphtha in order to form a hydrotreated intermediate cat naphtha at a third temperature greater than the second temperature but less than the first temperature; and (c) heating an intermediate cat naphtha at a fourth temperature, the fourth temperature being less than the second temperature, with the hydrotreated intermediate cat naphtha and with the hydrotreated heavy cat naphtha in order to form the heated intermediate cat naphtha.

2. The process of claim 1 further comprising combining the hydrotreated heavy cat naphtha and the hydrotreated intermediate cat naphtha.

3. The process of claim 2 further comprising separating $H_2S$ from the combined hydrotreated heavy cat naphtha and the hydrotreated intermediate cat naphtha.

4. The process of claim 1 wherein the second hydrotreating catalyst is a porous catalyst comprising:

(a) $MoO_3$ at a concentration of about 1 to 10 wt. %, based on the total weight of the second catalyst;

(b) CoO at a concentration of about 0.1 to 5 wt. %, based on the total weight of the second catalyst;

wherein the second catalyst has a Co/Mo atomic ratio of about 0.1 to about 1.0; a median pore diameter of about 60 Å to about 200 Å; a $MoO_3$ surface concentration of about $0.5\times10^{-4}$ to about $3\times10^{-4}$ g $MoO_3/m^2$; and an average particle size diameter of less than 2.0 mm.

5. The process of claim 1 wherein the heated intermediate cat naphtha contacts the second catalyst in the vapor phase at a pressure ranging from about 100 psig to about 300 psig, a hydrogen treat rate ranging from about 1000 SCF/B to about 2500 SCF/B, and a feed rate ranging from about 1 LHSV to about 5 LHSV.

6. The process of claim 5 wherein the second temperature ranges from about 475° F. to about 600° F. and wherein the third temperature ranges from about 525° F. to about 675° F.

* * * * *